US006240815B1

(12) United States Patent
Huang

(10) Patent No.: US 6,240,815 B1
(45) Date of Patent: Jun. 5, 2001

(54) WORKPIECE CLAMPING DEVICE

(76) Inventor: Chun-Nuan Huang, 26, Lane 25, Tzu Sun Road, Ta Li City, Taichung Hsien (TW)

( * ) Notice: Subject to any disclaimer, the term of this patent is extended or adjusted under 35 U.S.C. 154(b) by 0 days.

(21) Appl. No.: 09/583,993

(22) Filed: May 30, 2000

(51) Int. Cl.[7] ..... B25B 7/14

(52) U.S. Cl. ..... 81/328; 81/314; 81/423; 269/6

(58) Field of Search ..... 81/314, 319–325, 81/328, 338, 340, 392, 419, 421–424; 269/6

(56) References Cited

U.S. PATENT DOCUMENTS 1,134,980 * 4/1915 Warga ..... 81/325 X
1,616,621 * 2/1927 Hooks ..... 81/314 X
5,231,763 * 8/1993 Laux ..... 81/314 X

* cited by examiner

*Primary Examiner*—D. S. Meislin
(74) *Attorney, Agent, or Firm*—W. Wayne Liauh

(57) ABSTRACT

A workpiece clamping device is formed of a first handle and a second handle which is pivoted with the first handle by a pivot in conjunction with a torsion spring. The first and the second handles are provided with a clamping portion having a head end. The head end is provided with a spherical cavity and a spring for fastening a clamping block which can be adjusted in angle and surface to facilitate the clamping of workpieces of various dimensions. The first and the second handles are provided in the pivoting portions thereof with a ratchet for providing a retaining mechanism so as to hold securely a workpiece. The workpiece is let go by a press block which causes the disengagement of the ratchets.

3 Claims, 10 Drawing Sheets

WORKPIECE CLAMPING DEVICE

FIELD OF THE INVENTION

The present invention relates generally to a hand tool, and more particularly to a workpiece clamping device.

BACKGROUND OF THE INVENTION

As shown in FIG. 1, a workpiece clamping device 10 of the prior art comprises two clamping blocks 12 and 13, which are adjusted by a bolt 11 to facilitate the clamping of a workpiece between the two clamping blocks 12 and 13. The workpiece is held securely by the clamping blocks 12 and 13 at the time when the handle 14 is pressed against the urging plate 15. If additional pressure is called for, the press plate 16 is pressed. The prior art device 10 is defective in design in that the workpiece can not be easily held, and that it is rather inconvenient to rotate the blot 11 to open up the two clamping blocks 12 and 13.

As shown in FIGS. 2 and 3, another prior art device 20 comprises a press rod 21, which must be pressed to actuate the connection rods 22 and 23 so as to force the push rod 24 to extend, thereby causing the locking piece 25 to slant to retain the slide rail 26. As a result, a workpiece is held between the two clamping blocks 28 and 29. The prior art device 20 is defective in design in that it can not clamp the workpiece with ease and speed.

SUMMARY OF THE INVENTION

The primary objective of the present invention is to provide a workpiece clamping device which is easy to use.

It is another objective of the present invention to provide a workpiece clamping device capable of clamping the workpiece quickly.

It is still another objective of the present invention to provide a workpiece clamping device capable of clamping the workpieces of various dimensions.

The objectives, features, and advantages of the present invention will be readily appreciated and understood upon a thoughtful deliberation of the following detailed description of a preferred embodiment of the present invention with reference to the accompanying drawings.

DETAILED DESCRIPTION OF THE PREFERRED EMBODIMENT

Figure 1:
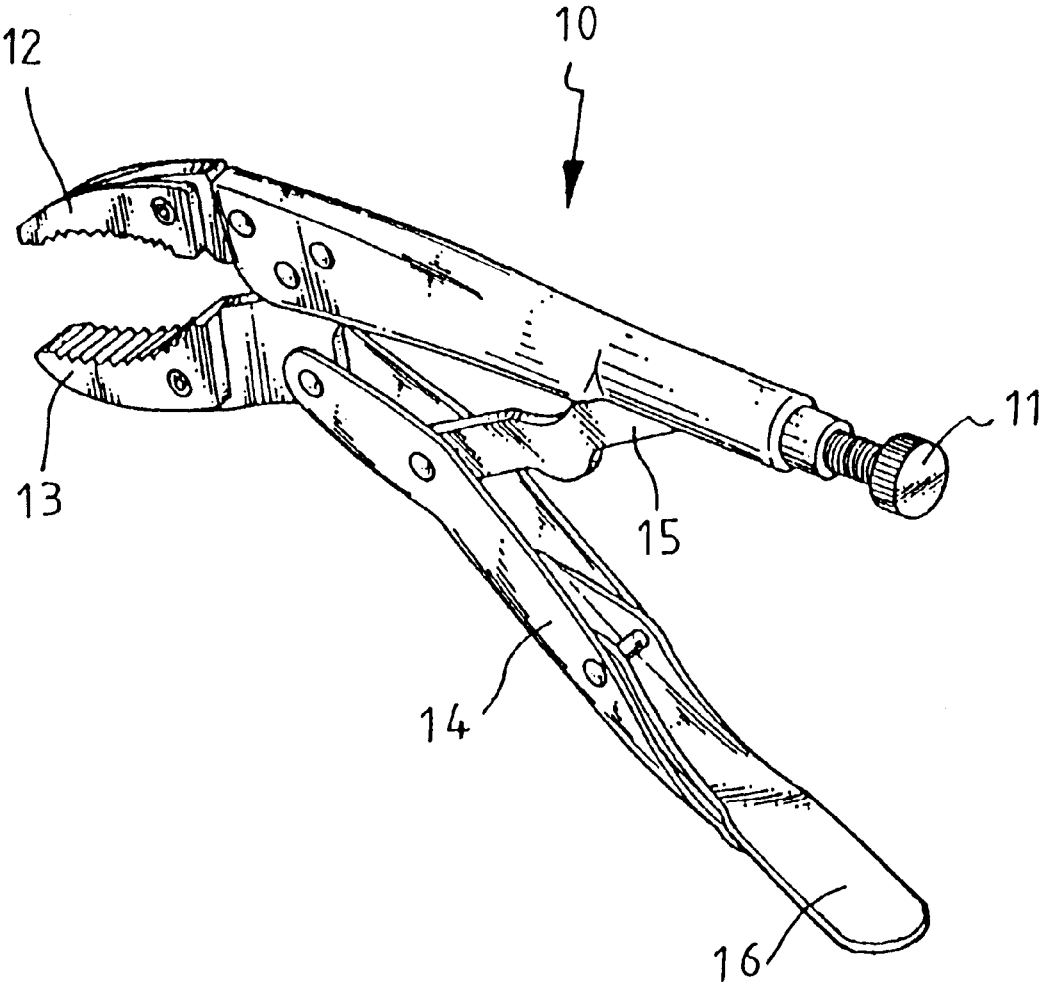
FIG. 1 PRIOR ART
FIG. 1 shows a schematic view of a workpiece clamping device of the prior art.
Figure 2:
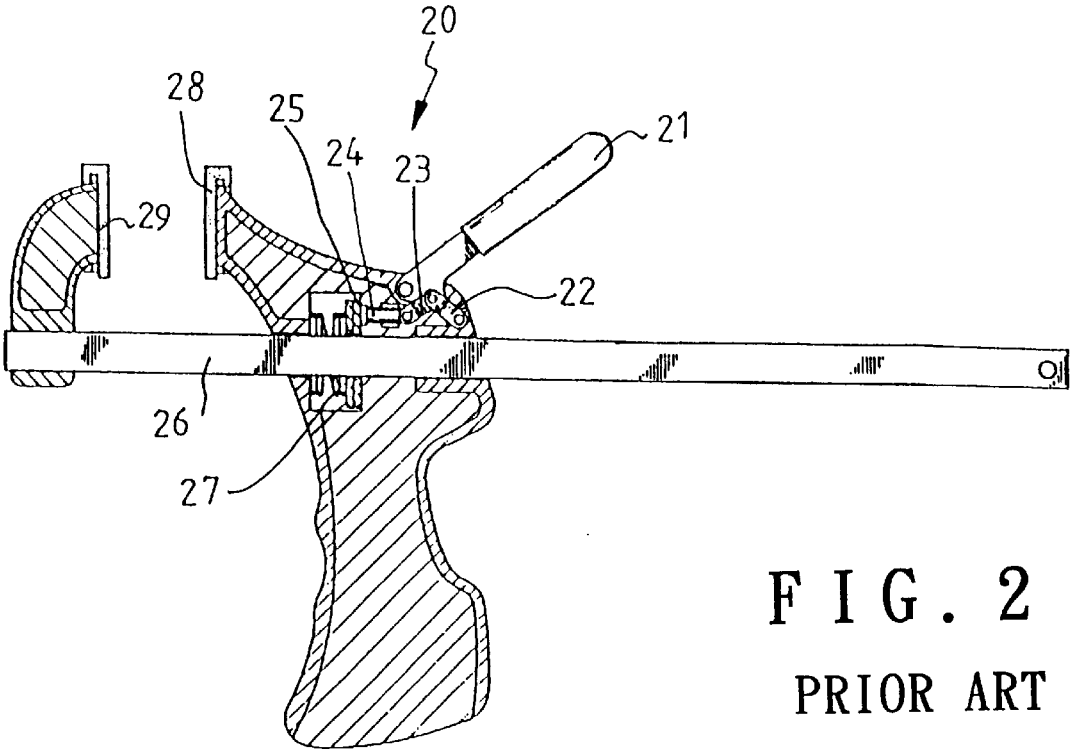
FIG. 2 PRIOR ART
FIG. 2 shows a schematic view of another prior art workpiece clamping device.
Figure 3:
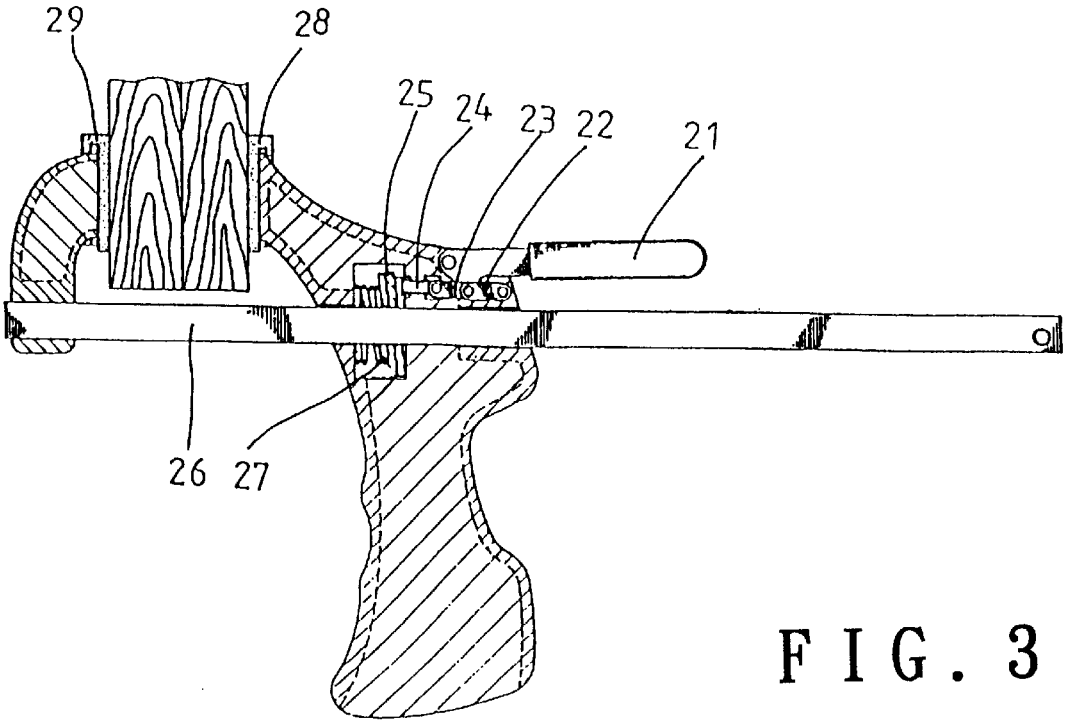
FIG. 3 PRIOR ART
FIG. 3 shows a schematic view of the action of the prior art device as shown in FIG. 2.
Figure 4:
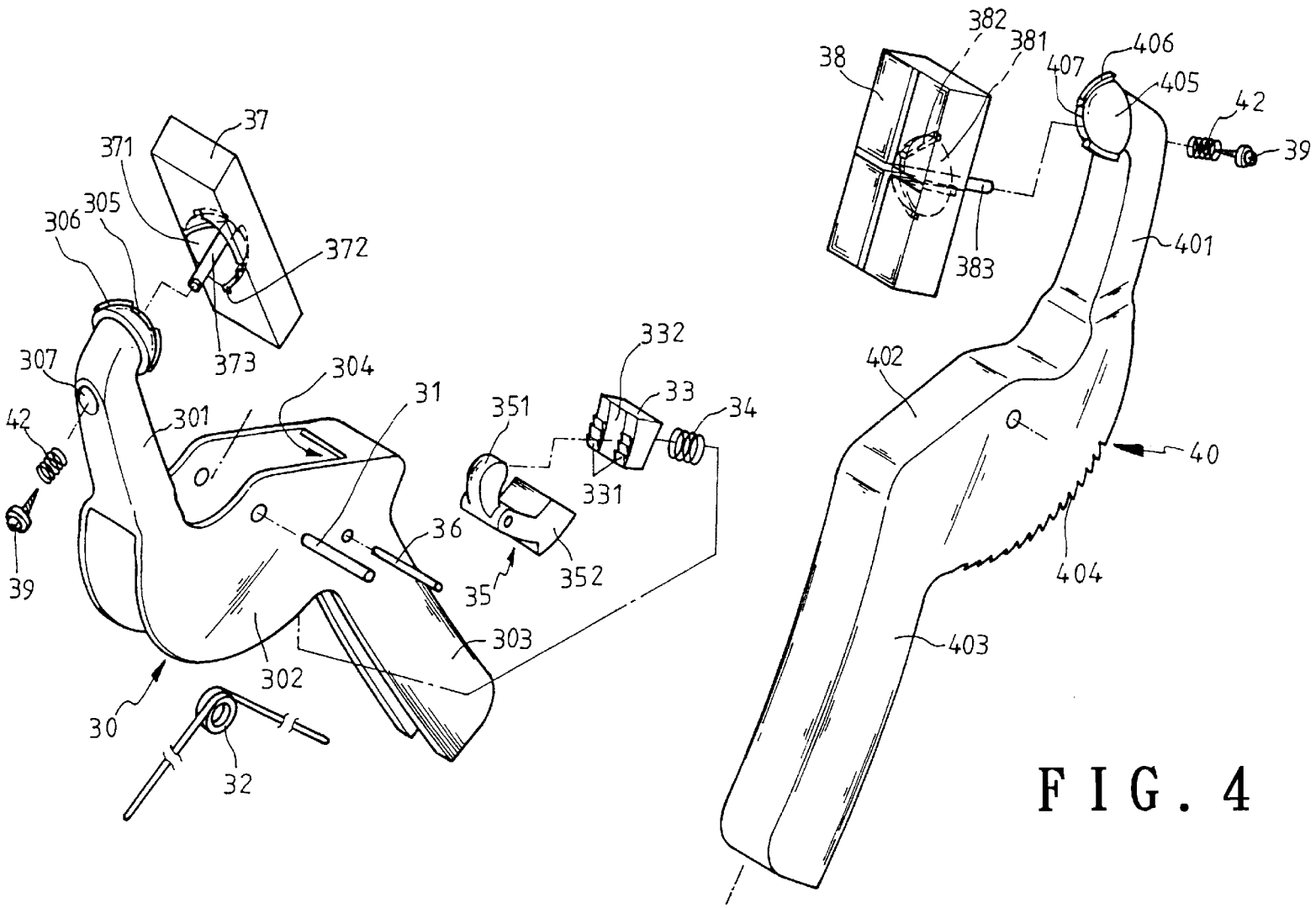
FIG. 4 shows an exploded view of the present invention.
Figure 5:
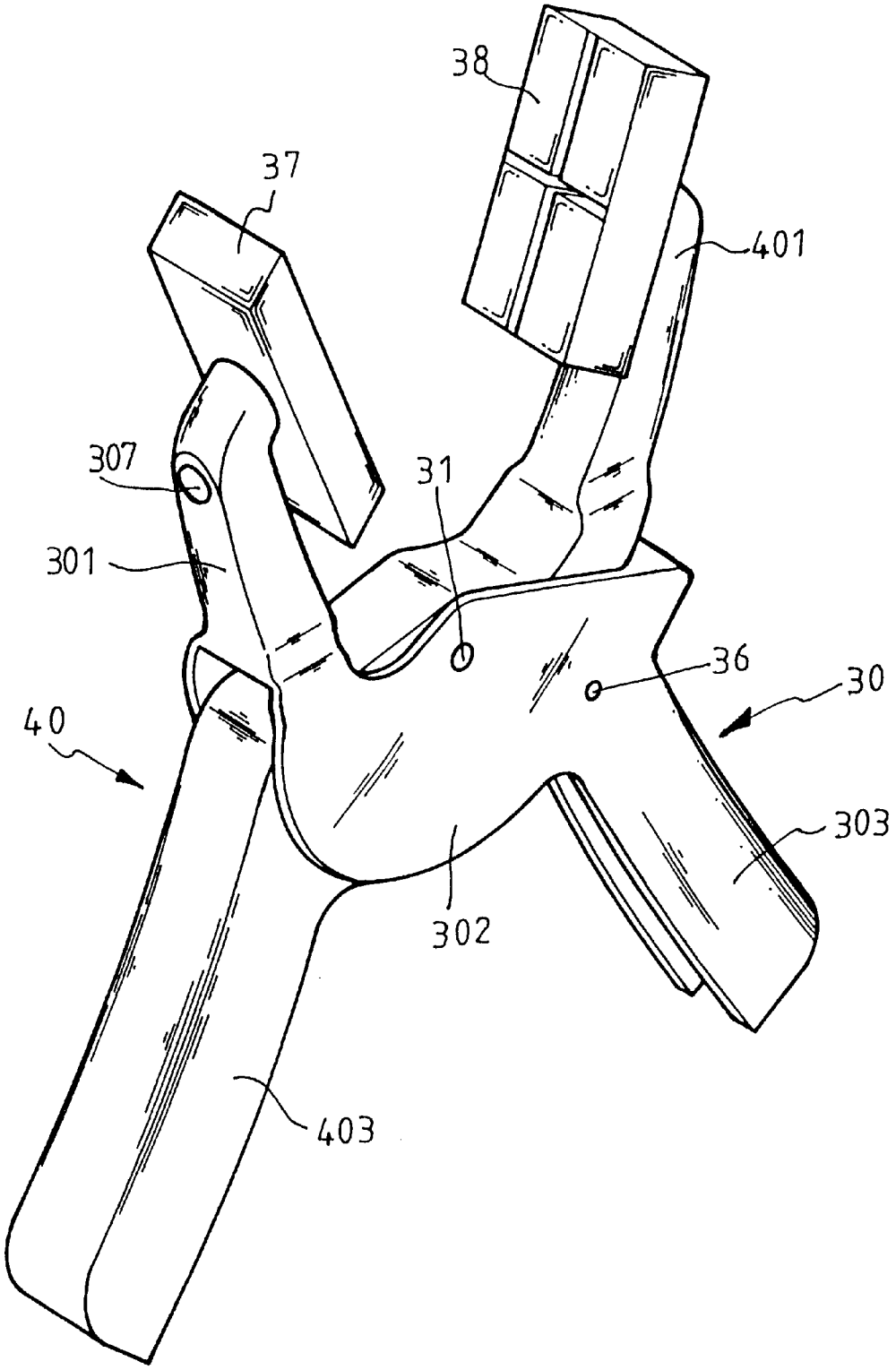
FIG. 5 shows a perspective view of the present invention in combination.
Figure 6:
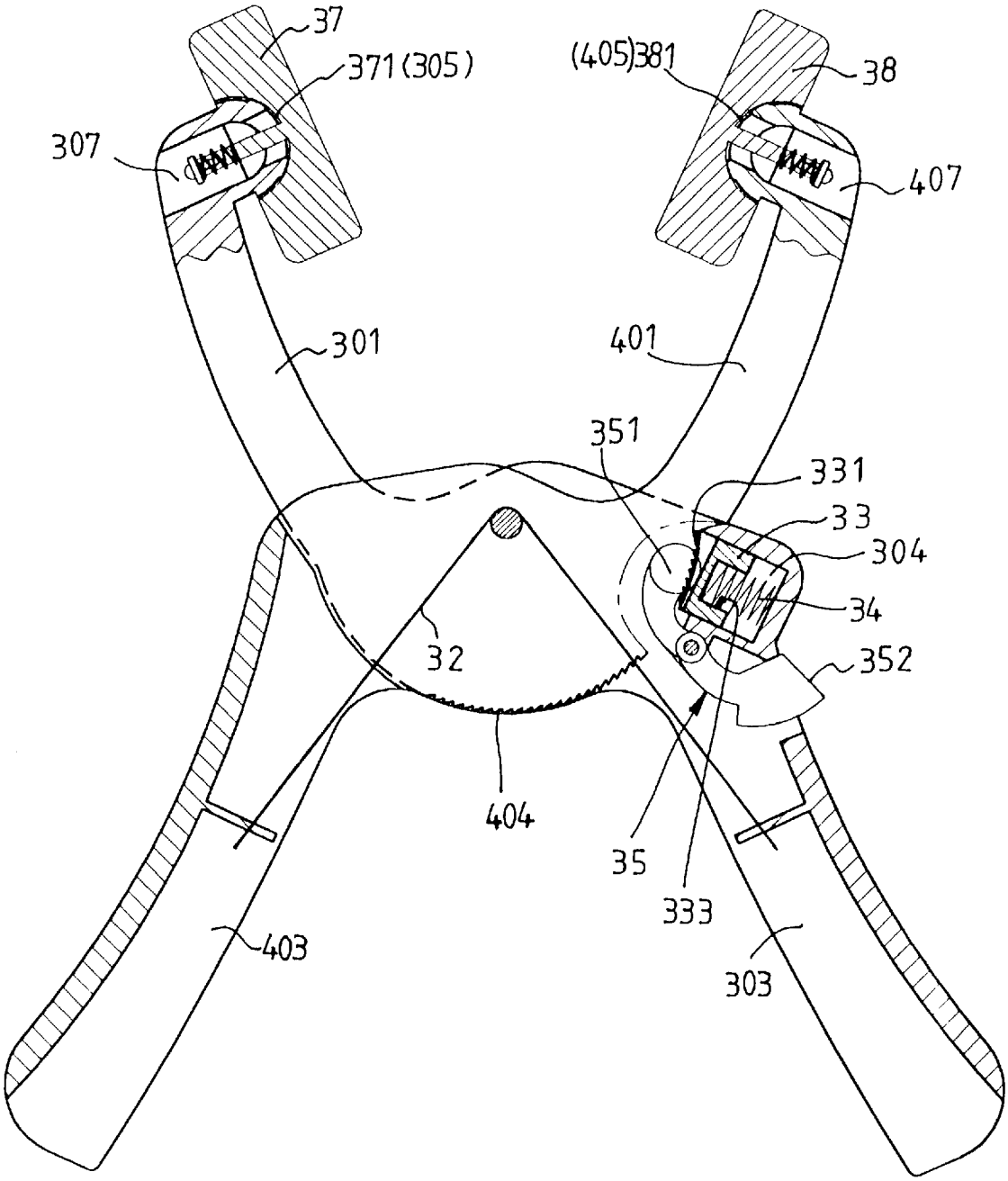
FIG. 6 shows a sectional schematic view of the present invention.
Figure 7:
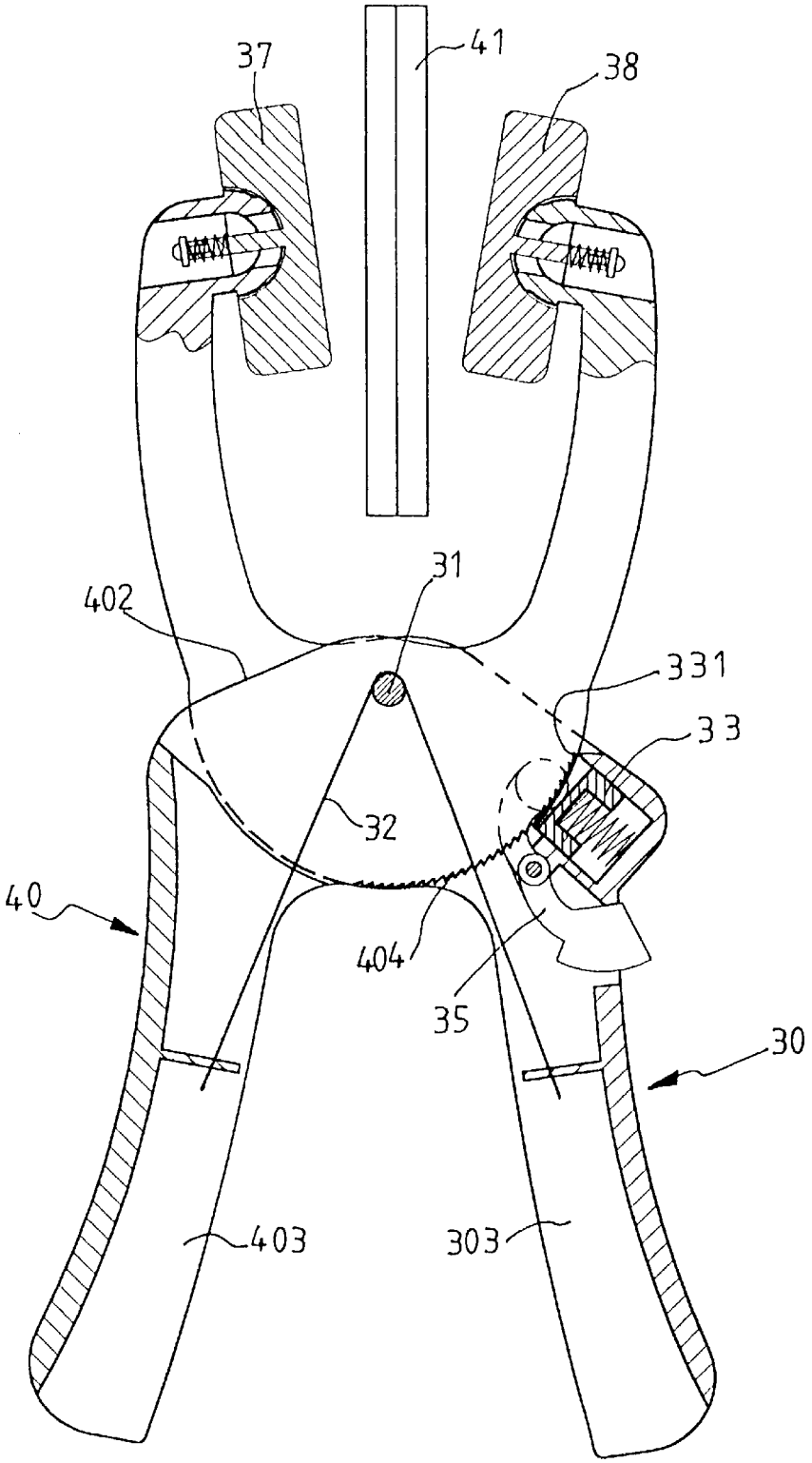
FIGS. 7–9 are schematic views of the present invention in use.
Figure 8:
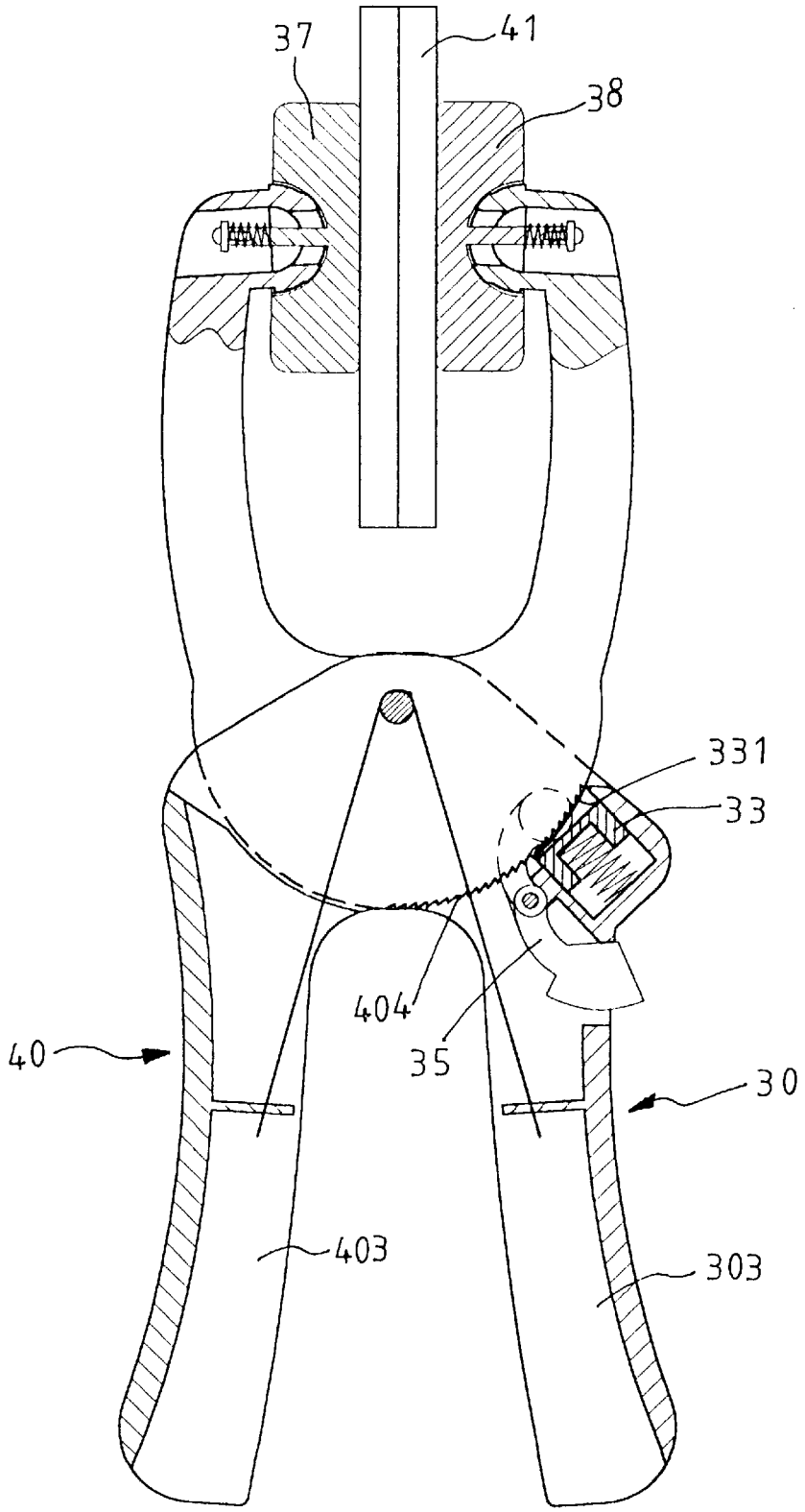
Figure 9:
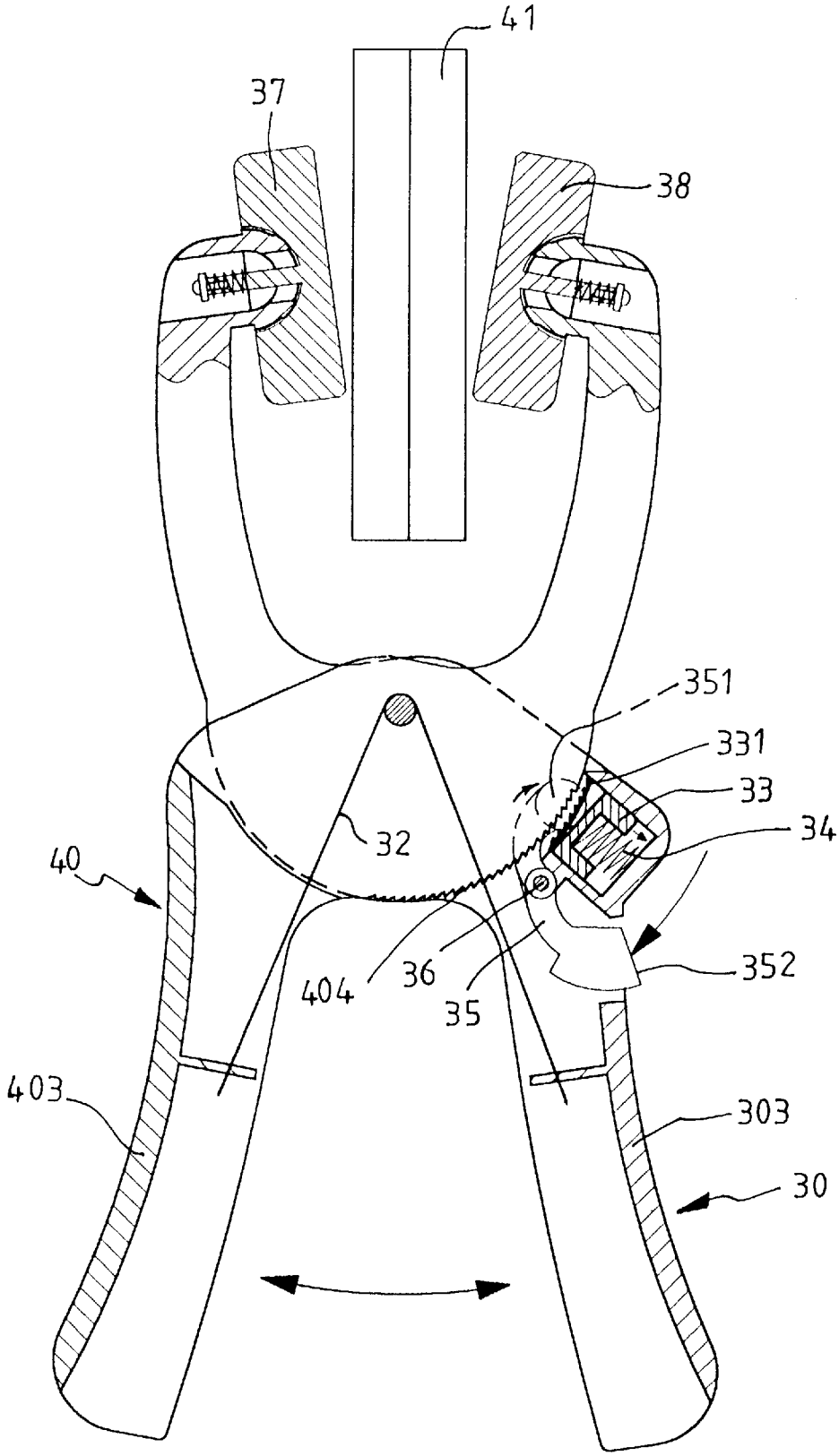
Figure 10:
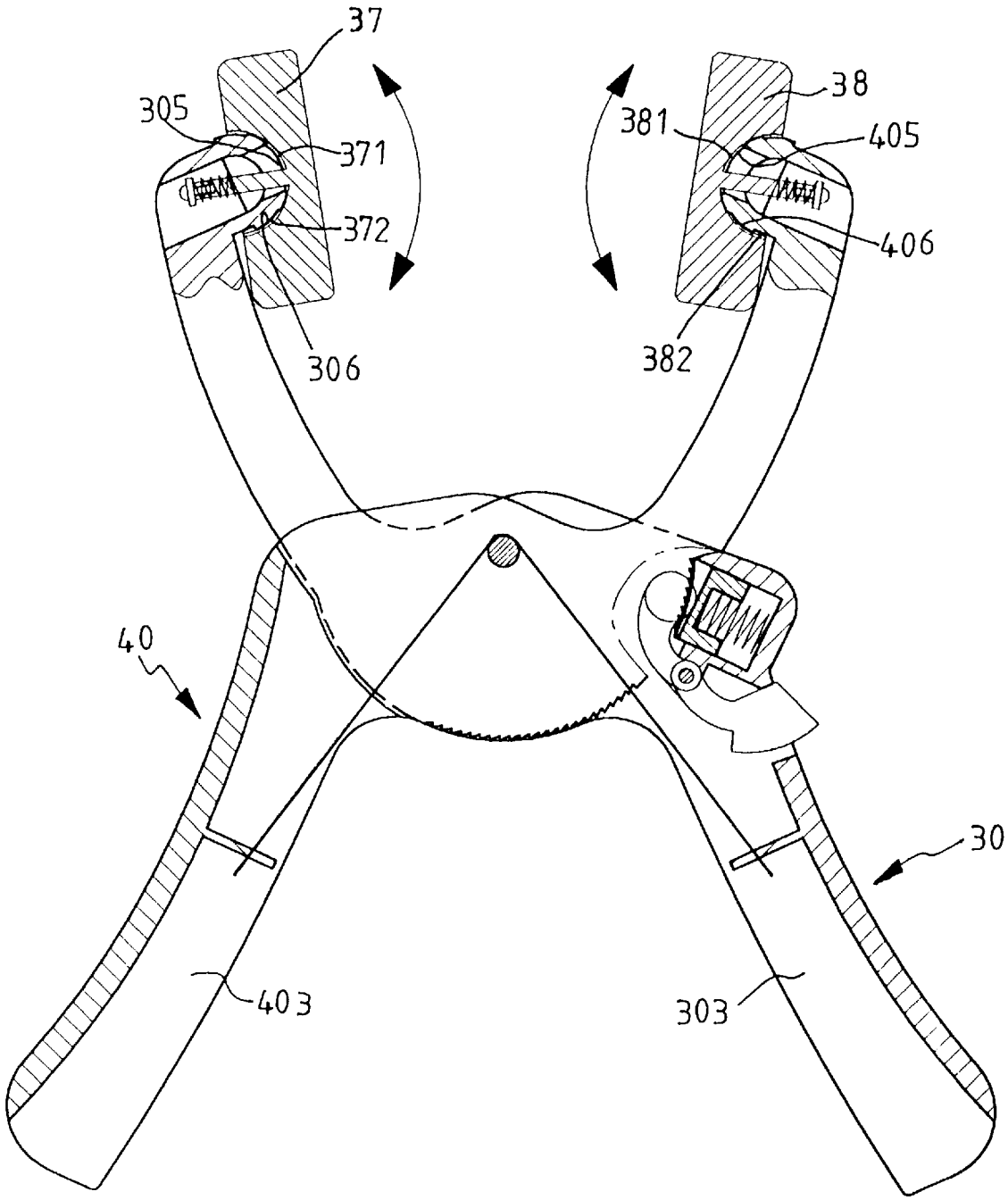
FIG. 10 shows a schematic view of the adjusting of the clamping angle of the clamping blocks of the present invention.
Figure 11:
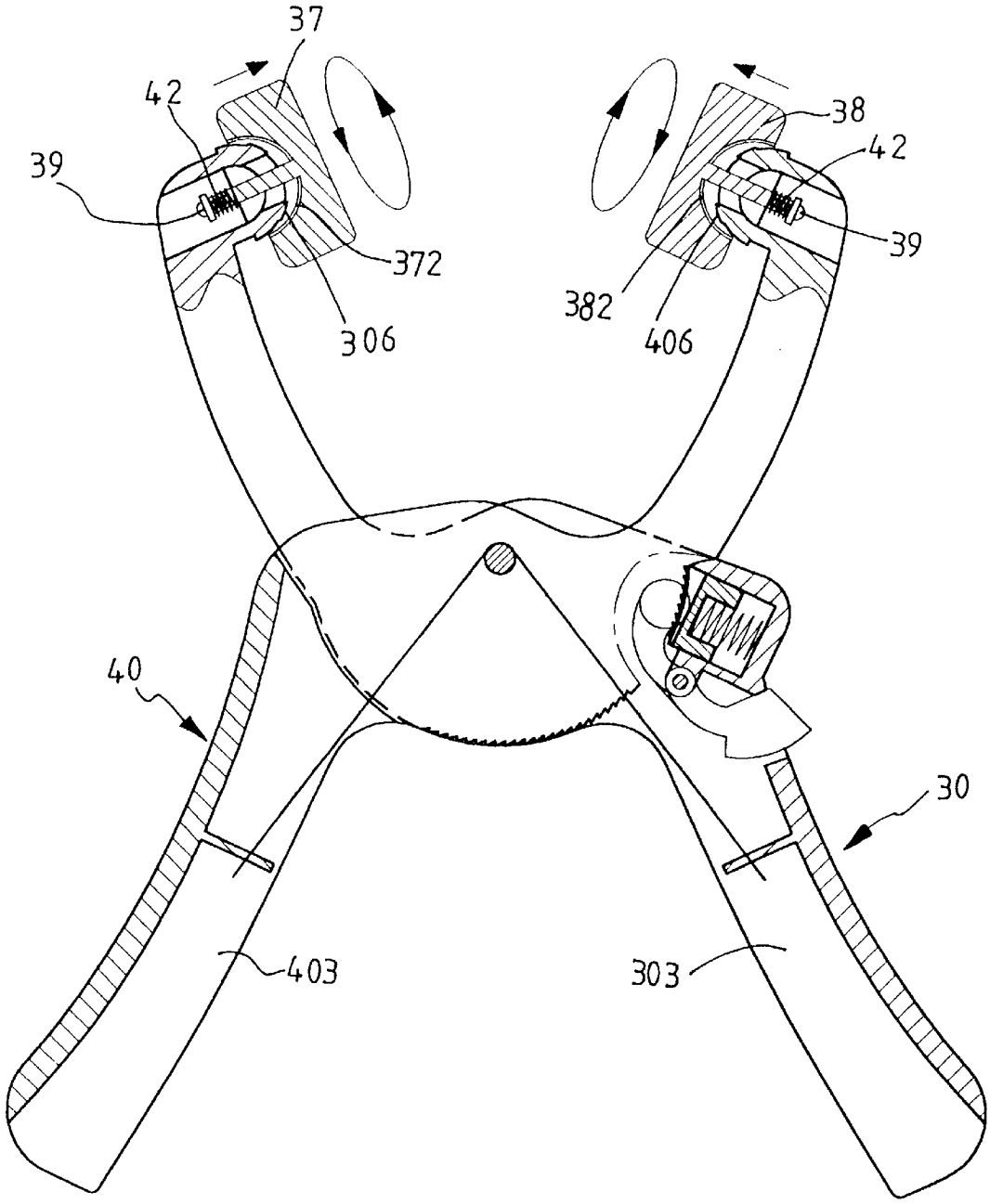
FIG. 11 shows a schematic view of the adjusting of the clamping surface of the clamping blocks of the present invention.

As shown in FIGS. 4–6, a workpiece clamping device embodied in the present invention comprises two handles 30 and 40, which are provided with a clamping portion 301, 401, a pivoting portion 302, 402, and a grip portion 303, 403. The pivoting portions 302 and 402 are of a hollow construction and are intended to fasten pivotally the two handles 30 and 40 in conjunction with a pivot 31 and a torsion spring 32. The pivoting portion 402 of the handle 40 is provided with a ratchet 404, whereas the pivoting portion 302 of the handle 30 is provided with an insertion slot 304 corresponding in location to the ratchet 404. A retaining block 33 is provided in two sides thereof with a ratchet 331, a press surface 332, a recess 333. A locating spring 34 and the retaining block 33 are disposed in the insertion slot 304. The ratchet 331 of the retaining block 33 is urged by the spring force of the spring 34 to mesh with the ratchet 404 of the handle 40. A press block 35 is pivoted by a pivot 36 in the pivoting portion 302 of the handle 30 such that the front end 351 of the press block 35 urges the press surface 332 of the retaining block 33. The clamping portions 301 and 401 are provided with a head end 305, 405 of a semispherical construction. The head ends 305 and 405 are provided with a retaining rib 306, 406; a stepped hole 307, 407. Two clamping blocks 37 and 38 are provided with a spherical cavity 371, 381; and a rib slot 372, 382; and a pillar 373, 383. A bolt 39 is fitted into a spring 42 is used to fasten the clamping blocks 37 and 38. As shown in FIG. 7, a workpiece 41 is clamped by the clamping blocks 37 and 38 as a result of the opposite motions of the ratchet 404 of the pivoting portion 402 and the ratchet 331 of the retaining block 33. Now referring to FIG. 8, the workpiece 41 is shown to be securely held by the clamping blocks 37 and 38 even if the grip portions 303 and 403 are relieved of the force exerting thereon by virtue of the fact that the ratchets 404 and 331 are engaged with each other. As shown in FIG. 9, the workpiece 41 is released by pressing the rear end 352 of the press block 35 such that the press block 35 turns on the pivot 36, and that the front end 351 of the press block 35 urges the press surface of the retaining block, thereby resulting in the compression of the spring 34 by the retaining block and the disengagement of the ratchet 331 with the ratchet 404 of the handle 40. The two handles 30 and 40 are thus forced apart by the spring force of the torsion spring 32. As shown in FIG. 10, the clamping blocks 37 and 38 can be adjusted in angle to facilitate the clamping of workpieces of various dimensions in view of the clamping blocks 37 and 38 capable of being guided to slide by the retaining ribs 306 and 406 as well as the rib slots 372 and 382 in conjunction with the fitting of the spherical cavities 371 and 381 with the head ends 305 and 405. In addition, the clamping blocks 37 and 38 can be adjusted in the clamping surface by using the bolt 39 to compress the spring 42 so as to cause the rib slots 372 and 382 to separate from the retaining ribs 306 and 406, as shown in FIG. 11. The clamping blocks 37 and 38 can be thus rotated to adjust the direction in which the clamping surface faces.

The embodiment of the present invention described above is to be regarded in all respects as being merely illustrative and not restrictive. Accordingly, the present invention may be embodied in other specific forms without deviating from the spirit thereof. The present invention is therefore the be limited only by the scopes of the following appended claims.

What is claimed is:

1. A workpiece clamping device comprising:

a first handle provided with a first clamping portion, a first pivoting portion, and a first grip portion, said first clamping portion having a head end which is provided with a retaining rib and a stepped through hole, said first pivoting portion being hollow and having an insertion slot;

a second handle provided with a second clamping portion, a second pivoting portion, and a second grip portion, said second handle being fastened pivotally with said first handle by a pivot in conjunction with a spring, said second clamping portion having a head end which is provided with a retaining rib and a stepped through hole, said second pivoting portion provided with a ratchet;

a retaining block provided with a ratchet which is engaged with said ratchet of said second pivoting portion of said second handle, said retaining block further provided with a spring which is disposed in said insertion slot of said first handle;

a press block fastened pivotally by a pivot to said first pivoting portion of said first handle such that one end of said press block urges said retaining block, and that other end of said press block extends beyond said first grip portion of said first handle; and two clamping blocks each being provided in an inner side thereof with a clamping surface, and in an outer side thereof with a spherical cavity and a rib slot whereby said two clamping blocks are fastened respectively with said head ends of said first clamping portion and said second clamping portion by a fastening bolt which is fitted into a spring.

2. The workpiece clamping device as defined in claim 1, wherein said ratchet of said retaining block is provided with a press surface whereby said press surface is urged by said one end of said press block.

3. The workpiece clamping device as defined in claim 1, wherein said retaining block is provided with a receiving slot for accommodating a locating spring.

* * * * *